United States Patent [19]

Noda

[11] Patent Number: 4,642,978

[45] Date of Patent: Feb. 17, 1987

[54] PNEUMATIC SPINNING APPARATUS

[75] Inventor: Koshi Noda, Joyo, Japan

[73] Assignee: Murata Kikai Kabushiki Kaisha, Kyoto, Japan

[21] Appl. No.: 757,637

[22] Filed: Jul. 22, 1985

[30] Foreign Application Priority Data

Jul. 26, 1984 [JP] Japan ..... 59-156230

[51] Int. Cl.[4] ..... D01H 5/28; D02G 1/04; F01N 1/00; F01N 1/10

[52] U.S. Cl. ..... 57/328; 57/1 R; 57/333

[58] Field of Search ..... 57/1 R, 328, 333, 350; 28/271–276

[56] References Cited

U.S. PATENT DOCUMENTS

| | | | |
|---|---|---|---|
| 3,713,509 | 1/1973 | Carroll | 57/1 R X |
| 4,024,698 | 5/1977 | Weiss et al. | 57/1 R X |
| 4,183,202 | 1/1980 | Morihashi | 57/328 |
| 4,437,302 | 3/1984 | Anahara et al. | 57/333 |
| 4,497,167 | 2/1985 | Nakahara et al. | 57/328 |
| 4,503,662 | 3/1985 | Horiuchi et al. | 57/328 X |

*Primary Examiner*—John Petrakes

*Attorney, Agent, or Firm*—Barnes, Kisselle, Raisch, Choate, Whittemore & Hulbert

[57] ABSTRACT

A pneumatic spinning apparatus wherein a sliver is introduced into an air injection nozzle in which the sliver is acted upon by a flow of compressed air to produce a spinning yarn. A silencer is connected in contiguous relationship to an exhaust air hole of the nozzle.

1 Claim, 7 Drawing Figures

PNEUMATIC SPINNING APPARATUS

FIELD OF THE INVENTION AND RELATED ART STATEMENT

This invention relates to a pneumatic spinning apparatus.

Spinning apparatus of the pneumatic type such as disclosed in U.S. Pat. No. 4,497,167 are developed in place of those of the ring type or the open end type. In an apparatus of this type, a sliver drafted is acted upon by a whirling flow of compressed air to produce a spinning yarn, and thus such an apparatus includes a nozzle for injecting an air flow.

A spinning apparatus of the pneumatic type presents a great advantage that it can effect spinning at a high speed ten times of that of the ring type, but it has a drawback that production of certain noises cannot be avoided similarly to spinning apparatus of any other type.

OBJECT AND SUMMARY OF THE INVENTION

Thus, it is an object of the present invention to reduce such noises of pneumatic spinning apparatus to improve operating environment.

According to the present invention, a silencer for exhaust air which may be named otherwise as a muffler is connected in contiguous relationship to an exhaust air hole of a nozzle for injecting compressed air therefrom. The silencer may be of the diffuser type which has a great number of ventilating holes, or of any other known type.

According to the invention, noises when compressed air goes out from an exhaust air hole to expand are reduced by actions of the silencer such as reduction of destructive energy of an air flow, reflection of acoustic waves, absorption of sound, and so on.

DETAILED DESCRIPTION OF PREFERRED EMBODIMENTS

The present invention will be described in detail referring to the attached drawings.

Figure 2:
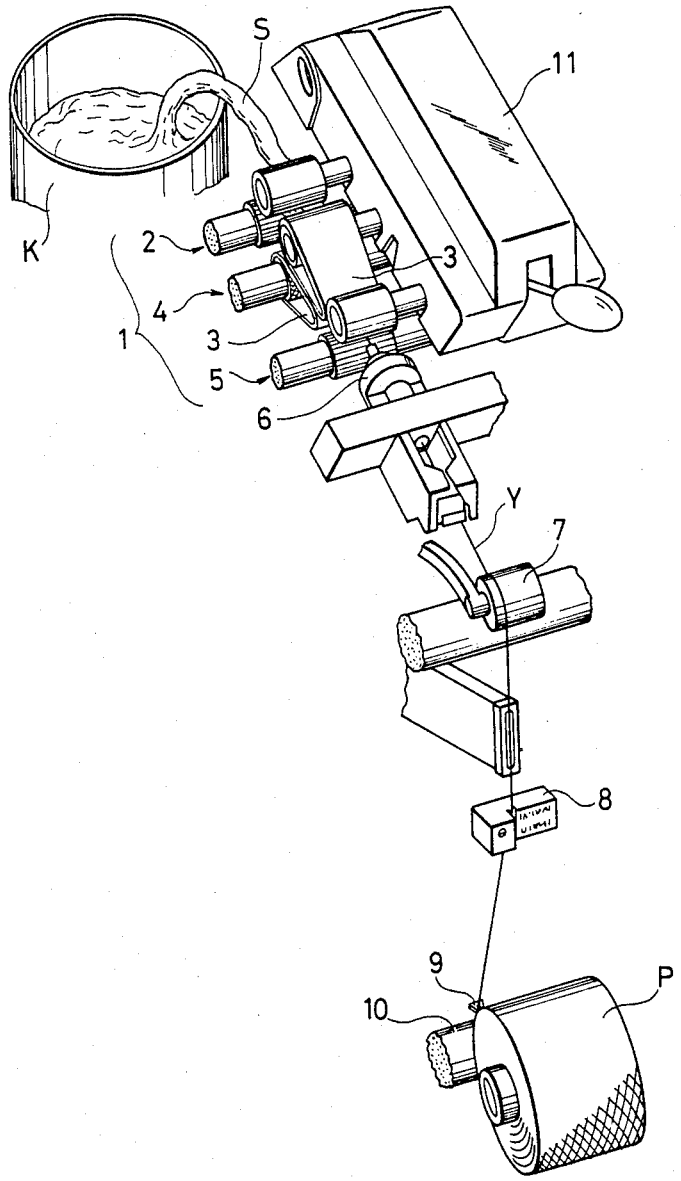
FIG. 2 a perspective view showing general construction of a pneumatic spinning apparatus.

FIG. 2 shows general configuration of a pneumatic spinning apparatus.

A sliver S made of staple fibers and drawn out of a sliver can K passes a back roller 2, a middle roller 4 having an apron 3 and a front roller 5 in order so as to be drafted to a predetermined thickness and is then introduced into an air injection nozzle 6. The sliver S is thus twisted by the nozzle 6 into a spinning yarn Y and is then drawn out by a delivery roller 7. Then, after it has passed a slub catcher 8, it is wound onto a winding package P which is contacted with and rotated by a friction roller 10 which it is traversed by a traverse guide 9.

Figure 1:
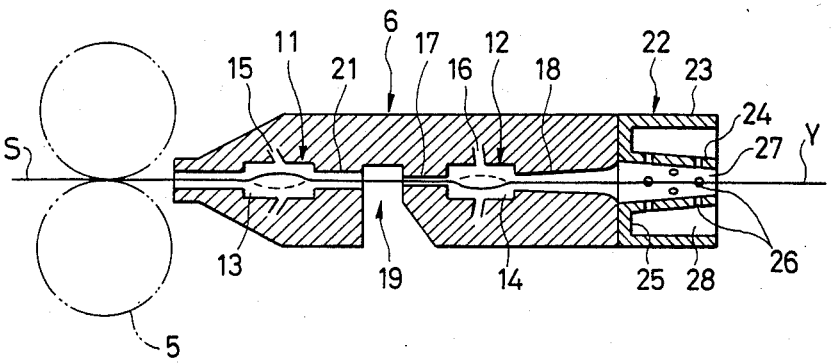
FIG. 1 is a cross sectional view of an air injection nozzle and a silencer.

FIG. 1 illustrates a structure of the air injection nozzle 6.

The nozzle 6 has two nozzles 11 and 12 located in order therein along a travelling path for the sliver S. Air injection holes 15 and 16 are opened tangentially to cylindrical yarn passing holes 13 and 14 of the nozzles 11 an 12, respectively. Thus, flows of compressed air are injected in from the air injection holes 15 and 16. The air injection holes 15 and 16 are opened in opposite directions to each other so that the air flows may whirl in opposite directions to each other in the yarn passing holes 13 and 14. Besides, the injection holes 15 and 16 are inclined in different angles in a front elevational view as seen in FIG. 1, and the injection holes 15 of the first nozzle 11 are inclined toward the advancing direction of the sliver S which the injection holes 16 of the second nozzle 12 are inclined almost at right angles. In addition, a yarn entrance 17 and a yarn exit 18 of the second nozzle have different diameters from each other such that the diameter of the yarn exit 18 is greater than that of the yarn entrance 17 and the diameter increases towards the yarn exit 18. A recess 19 is formed between the first nozzle 11 and the second nozzle 12 so that compressed air within the first nozzle 11 may be discharged outside from the yarn exit 21 via the recess 19.

A silencer 22 made of a metal material such as aluminum is securely fixed to a rear end of the air injection nozzle 6. The silencer 22 includes a hollow outer cylinder 23 and inner cylinder 24, and a connecting portion 25 for connecting the silencer 22 to a rear end of the nozzle 6. The inner cylinder 24 is located in coaxial relationship to the yarn exit 18 of the second nozzle 18. Further, the inner cylinder 24 is gradually reduced in diameter toward the advancing direction of the sliver S and has a great number of small ventilating holes 26 perforated in a circumferential wall thereof.

The sliver S which has passed the front roller 5 is acted upon and temporarily twisted by whirling flows of compressed air in the second nozzle 12, and such twist formed by the temporary twisting is propagated to a nip point of the front roller 5. The first nozzle 11 balloons the sliver S having the twist to a direction opposite to the twist with the whirling air flows from the injection holes 15 thereof so as to detach or separate fibers of part of the sliver which has just come out of the front roller 5 and coils the thus separated fibers around other fibers which are not separated. The coiling direction is the same with the direction of ballooning and thus reverse to the twist described above. Accordingly, as the sliver S passes the second nozzle 12 and is acted upon by untwisting action of the same, such coiling is strengthened so that the sliver S is formed into a banded spinning yarn Y.

Since the pressure of air flows of the second nozzle 12 is selected stronger than that of the first nozzle 11 and the injection nozzles 16 of the second nozzle are directed perpendicularly to the sliver S, air flows in the nozzle 12 act more strongly on the sliver S than air flows in the first nozzle 11. Further, since the yarn entrance 17 is small, air flows injected in the second nozzle 12 most pass the yarn exit 18 as an exhaust air hole and are sent into the inner cylinder 24 of the silencer 22. Compressed air supplied into the inner cylinder 24 partly passes through a center hole 27 in the inner cylinder together with the yarn Y while the other air passes through the ventilating hole 26 and then flows into an expansion chamber 28 formed between the inner cylinder 24 and the outer cylinder 23 whereafter it goes outside. As compressed air flows are blown out into the expansion chamber 28 from the ventilating holes 26, destructive energy of jets thereof is reduced and acoustic waves reflect and are partly consumed. Besides, the inner cylinder 24 makes a resisting member for acoustic waves while the expansion chamber 28 acts as a low pass filter. Accordingly, the silencer 28 acts to remarkably reduce noises which are to be produced when compressed air flows of the second nozzle 12 are discharged outside through the yarn exit 18 as an exhaust hole.

Graphs of FIGS. 3 and 4 show results of examinations conducted with the silencer as described above, and measurements were made for up to 6 such air injection nozzles which have no sliver S introduced therein. The abscissa of each graph shows the frequency of noises while the ordinate shows the level of noises. The silencer 22 used for the examination is 15 mm in length of the cylinder, 20 mm in outer diameter, 7.5 mm in inner diameter at the entrance of the center hole, 5 mm in inner diameter at the exit, and 12 in number and 2 mm in inner diameter of the ventilating holes 26, and is made of aluminum in material.

Figure 3A:
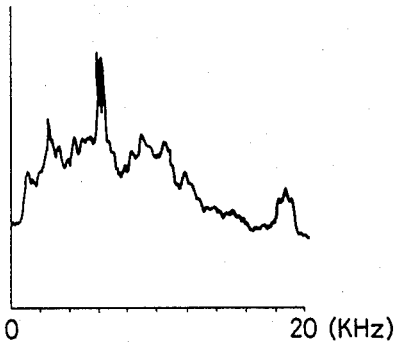
FIG. 3*a* and FIG. 3*b* and FIG. 4*a* and FIG. 4*b* are graphs showing results of examinations of the present invention.
Figure 3B:
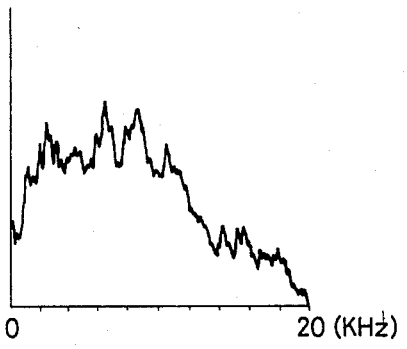

FIG. 3*a* shows results of the examination wherein the silencer 22 is not used and the pressure of air injected is 3 kg/cm$^2$ at the first nozzle 11 and 4 kg/cm$^2$ at the second nozzle 12. In this case, the dull noises were 50 dB(A) and the noises were 89 dB(A). Meanwhile, FIG. 3*b* shows results of the examination conducted under the same conditions as those of FIG. 3*a* using the silencer 22. In this case, the noises were 80 dB(A).

Figure 4A:
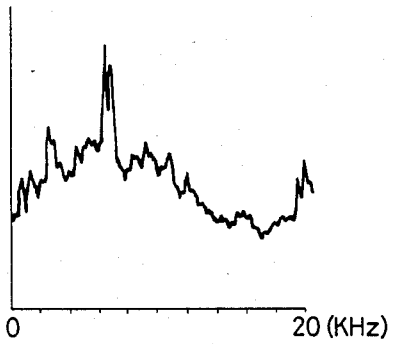
Figure 4B:
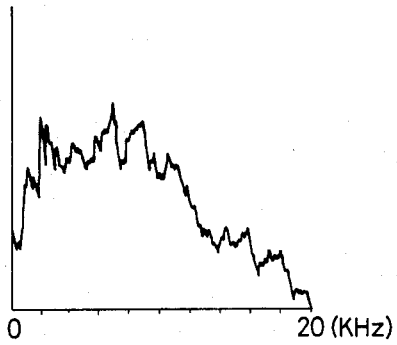

FIG. 4*a* shows results of the examination wherein the silencer 22 is not used and the pressure of air is 3 kg/cm$^2$ at the first nozzle 11 and 4.5 kg/cm$^2$ at the second nozzle 12. In this case, the dull noises were 50 dB(A) and the noises were 89 dB(A). Meanwhile, FIG. 4*b* shows results of the examination conducted under the same conditions as those of FIG. 4*a* using the silencer 22. In this case, the noises were 80 dB(A).

Figure 5:
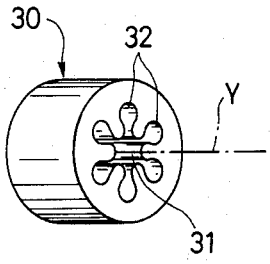
FIG. 5 is a perspective view illustrating another example of silencer.

FIG. 5 illustrates another example of silencer.

A silencer 30 is in the form of a cylinder and has a center hole 31 formed at the center thereof for passing a yarn Y therethrough and up to 6 grooves 32 formed in a circumferential wall thereof around the center hole 31. The silencer 30 is arranged such that the center hole 31 thereof communicates with the yarn exit 18 of the air injection nozzle 6 in a similar manner to the example of FIG. 1. Thus, since compressed air which goes out of the yarn exit 18 is dispersed into the grooves 32, noises to be caused are reduced. According to examinations using the silencer 30, some silencing effects were confirmed although they were lower than those of the example of FIG. 1.

According to the present invention, noises to be produced by a pneumatic spinning apparatus can be reduced or controlled assuredly. The noise preventing effects of the invention are remarkable in a plant having a great number of spinning apparatus, and thus operating environment can be improved markedly.

While the structure of a silencer of the present invention can be modified in various manners in designing, silencers which are provided in air injection nozzles for spinning and have a peculiar structure for silencing are included in the present invention. Accordingly, a silencer which is integral in structure with an air injection nozzle, a silencer associated with a nozzle having a different structure, and so on, are also anticipated by the present invention.

What is claimed is:

1. In a pneumatic spinning apparatus wherein multiple spindles utilizing spinning nozzles are provided on a single spinning frame and a sliver is introduced into each individual air injection nozzle in which the sliver is acted upon by a flow of compressed air to produce a spinning yarn, characterized in that each nozzle comprises first and second nozzles in tandem with air injection holes opened tangentially to cylindrical yarn passing holes of the nozzles, respectively, said first and second nozzles being formed in a unitary body provided with an escape recess formed between the first nozzle and the second nozzle so that compressed air within the first nozzle may be discharged outside the body through said recess, a silencer connected to said body in contiguous relationship at the yarn exit hole of the second nozzle to reduce sound emission from said nozzle, a yarn entrance hole and a yarn exit hole in the second nozzle having different diameters such that the diameter of the yarn exit hole is greater than that of the yarn entrance hole and the diameter of the exit hole increases toward the yarn exit hole, a solid annular wall surrounding the exit hole of said second nozzle, said silencer comprising a hollow cylindrical body which includes an outer cylinder, an inner cylinder and an annular connecting portion between said cylinders at the inner end to fit against said annular wall of said second nozzle for connecting the silencer to an exit end of the second nozzle, said inner cylinder being located in coaxial relationship to the yarn exit hole of the second nozzle and said hollow cylindrical body being opened at the exit end thereof between said cylinders to form an expansion chamber, said inner cylinder of the silencer being gradually reduced in diameter toward the advancing direction of the sliver, and having a plurality of small ventilating holes perforated in a circumferential wall thereof leading to said expansionl chamber to reduce the energy of the air and sound emission.

* * * * *